United States Patent [19]

Lung-Tung

[11] Patent Number: 4,499,840

[45] Date of Patent: Feb. 19, 1985

[54] METHOD FOR THE SALVAGE OF A SUNKEN VESSEL

[76] Inventor: Chao Lung-Tung, No. 32, Chung Cheng 4th Rd., Kaohsing City, Taiwan

[21] Appl. No.: 442,744

[22] Filed: Nov. 18, 1982

[51] Int. Cl.[3] ..... B63C 7/08

[52] U.S. Cl. ..... 114/51; 294/66 R

[58] Field of Search ..... 114/51, 50, 44, 222, 114/221 A, 221 R, 223, 52–55; 294/66.1; 43/17.2

[56] References Cited

U.S. PATENT DOCUMENTS

| | | | |
|---|---|---|---|
| 1,200,404 | 10/1916 | White | 294/66.1 |
| 1,353,623 | 9/1920 | Beckwith | 114/51 |
| 3,336,067 | 8/1963 | Cloyd | 294/66.1 |
| 3,807,336 | 4/1974 | Briggs | 114/51 |
| 4,016,728 | 4/1977 | Mason | 114/221 A |
| 4,051,797 | 10/1977 | Hausmann | 114/51 |

FOREIGN PATENT DOCUMENTS

| | | | |
|---|---|---|---|
| 14076 | 4/1911 | France | 114/51 |

*Primary Examiner*—Trygve M. Blix
*Assistant Examiner*—Stephen P. Avila

[57] ABSTRACT

This invention discloses a method for the salvage of a sunken vessel able to be carried out either in deep or shallow sea area by utilizing electromagnets to direct a conventional clamping apparatus in precisely and effectively clamping as well as lifting the sunken vessel hull.

1 Claim, 2 Drawing Figures

METHOD FOR THE SALVAGE OF A SUNKEN VESSEL

This invention relates to a method for the salvage of a sunken vessel.

Conventionally, the salvage of a sunken vessel is carried out by the diver who dives into the underwater sunken vessel to repair any damages and then charges air into said vessel to make it float up to the water surface. In this manner, it needs the diver to perform an underwater operation which is so troublesome and dangerous that it is subject to various limitations. Further, such operation is impossible to perform under deep sea circumstances.

The object of this invention is to provide a method for the salvage of a sunken vessel able to be carried out either in deep or shallow sea area, characterized by utilizing electromagnets to direct a conventional clamping apparatus in precisely and effectively clamping as well as lifting the sunken vessel hull. This may be advantageously in cooperation with at least one diving box for exhancing the buoyancy of said vessel so as to facilitate the lifting operation of the whole sunken vessel to the water surface.

This object is accomplished in accordance with this invention by a method for the salvage of a sunken vessel comprising the steps of detecting the location and depth of said sunken vessel, lowering successively two electromagnets with respective guide ropes from a salvage station to attach on said vessel along opposite sides thereof, providing a retaining rod interconnected therebetween having a length greater than the width of said vessel, lowering a clamping apparatus with a tailing rope and another retaining rod through said respective guide ropes to reach and clamp said vessel, and lifting said vessel by means of said electromagnets and said clamping apparatus with a conventional winding machine for lifting up said tailing ropes and said respective guide rope.

Figure 1:
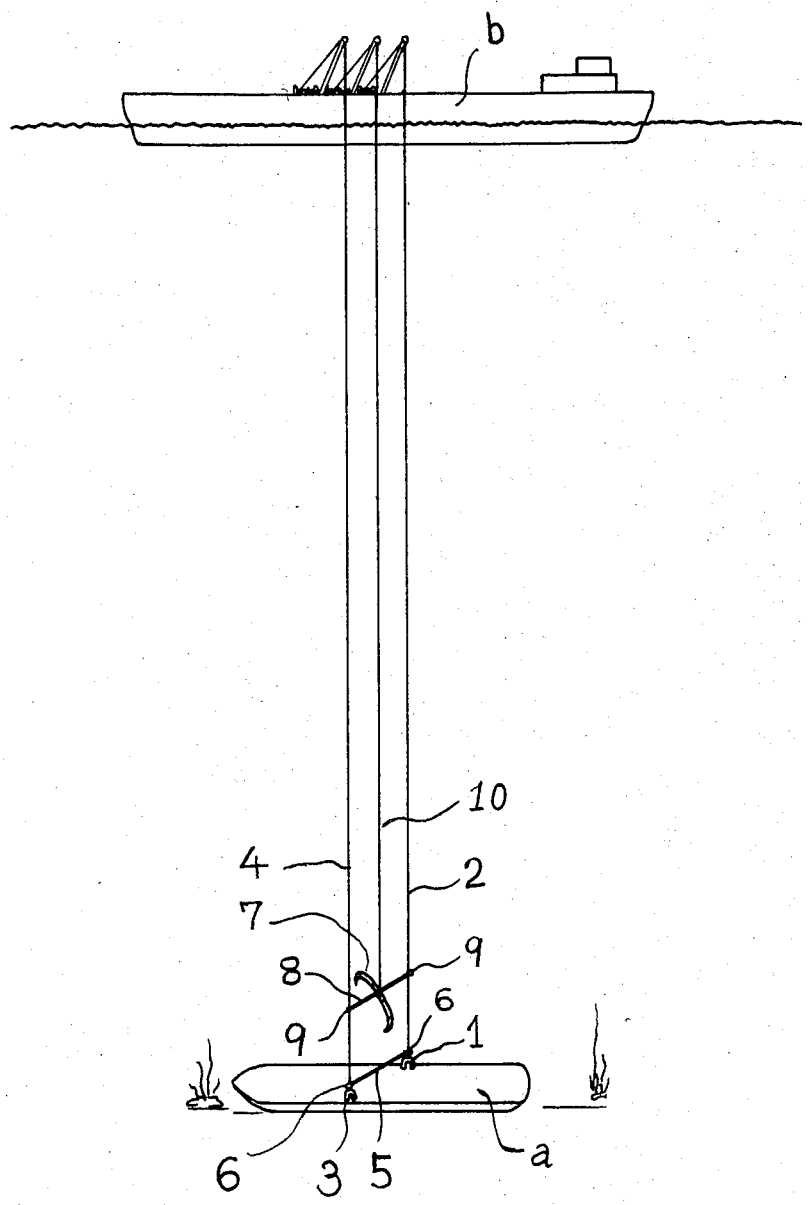
Figure 2:
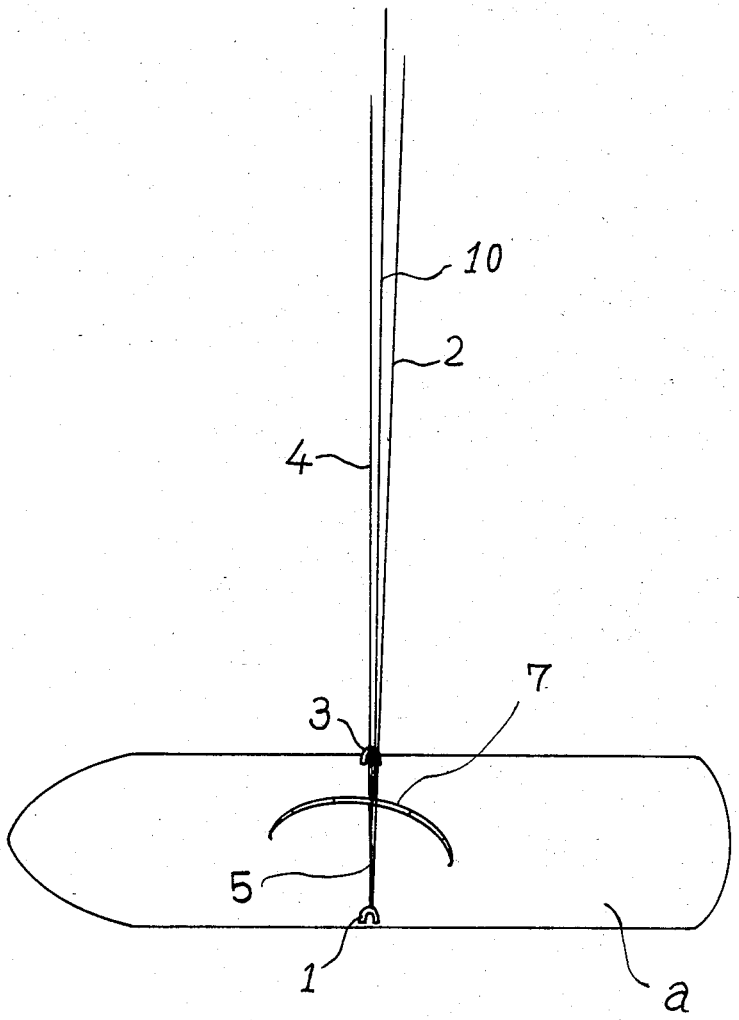

The aforementioned and other objects and features of this invention will be best understood from the following description with reference to the accompanying drawings, in which:

FIG. 1, is a schematic elevation illustrating the method according to the present invention; and FIG. 2 is a schematic elevation illustrating the inoperable arrangement causing the clamping apparatus to fail to work.

Now, referring to FIG. 1 of the drawings, in which a sunken vessel a lies on underwater ground and a salvage station b, such as a ship, like a floating dock, stays on the sea surface just at the location preparing for the salvage of said vessel a.

The first step of the present method for the salvage of the sunken vessel is naturally to detect the exact position and depth of a the sunken vessel by means of conventional electric wave detector and relevant necessary instruments. Such device and method for detection are not within the scope of this invention, the description thereof is thus omitted.

The next step is lowering an electromagnet 1 with a guide rope 2 which is controlled by a winding machine installed on said station b and not illustrated in the drawings. Said electromagnet 1 is advantageously attached along one side of the sunken vessel hull.

Successively, another electromagnet 3 is let down with its respective guide rope 4 in similar manner to attach along the opposite side of the same vessel a. A retaining rod 5 is interconnected between said ropes 2 and 4 by means of the retaining rings 6 at both ends thereof. The retaining rod 5 has a predetermined length greater than the width of said vessel a for the purpose of facilitating a subsequent clamping operation and so that the vessel a would be more stable during a subsequent lifting operation.

Next, a huge conventional clamping apparatus 7 is lowered with a tailing rope 10, by means of another retaining rod 8 having retaining rings 9, 9 at both ends and moved down along said guide rope 2 and 4 respectively. The rod 8 has a length substantially the same at that of the rod 5. The clamping apparatus 7 has its longitudinal axis substantially perpendicular to said rod 8, which is parallel to the rod 5.

Since the length of said rod 5 or rod 8 is greater than the width of the vessel a, so that when both electromagnets 1 and 3 on opposite ends of the rod 5 attach along opposite sides of the vessel a, the rod 5 will cross over said vessel a at an angle, and thus the clamping apparatus 7 will reach the vessel a at a complementary angle between the longitudinal axis of said clamping apparatus 7 and the direction of the keel of said vessel a. This will facilitate the clamping apparatus 7 to clamp and grip the vessel. Further, the clamping apparatus 7 in cooperation with two electromagnets 1 and 3 gives four fulcrums on the sunken vessel a resulting in more stable lifting.

Otherwise, as shown in FIG. 2, if the rod 5 has a length not greater than the width of the vessel a, the rod 5 will just be perpendicular to the keel of the vessel a. In that case, the clamping apparatus 7 has its longitudinal axis sustantially parallel or identical with that of the vessel a and thus unable to perform the clamping operation, and furthermore the vessel a is unstable.

Finally, a winding machine (not shown) placed on the station b is operated to wind up the tailing rope 10 and both guide ropes 2 and 4 for performing the lifting operation of the sunken vessel a. With the present method, the salvage of the sunken vessel a either under deep or shallow sea will be effectively carried out.

When the sunken vessel a is lifted to about the position where it leaves the water surface, the buoyancy is greatly reduced. At this time a carrier (not shown) provided with roller means may be extended from the station b to support the vessel a for readily pulling it up to said station b.

Accordingly, the assemblage of the device including the electromagnets 1, 3, guide ropes 2, 4, retaining rods 5, 8, clamping apparatus 7, and tailing rope 10 is not restricted to only one set as illustrated, rather more than one set may be employed at different pre-selected position(s) on the sunken vessel, if necessary.

The aforementioned embodiments serve only for illustrative purposes and by no means to restrict the scope of the present invention. Any modifications can easily be made by those skilled in the art and should be considered within the scope of the attached claims.

What I claim is:

1. A method for the salvage of a sunken vessel comprising the steps of detecting the location and depth of said sunken vessel, lowering successively two electromagnets with respective guide ropes from a salvage station together with a first retaining rod interconnected between said ropes, said first retaining rod having a length greater than the width of said vessel, thereby to attach said electromagnets on said vessel along opposite sides thereof at an angle other than 90° with respect to a longitudinal axis of said vessel, lowering a clamping apparatus together with a second retaining rod with a tailing rope utilizing said respective guide ropes, said clamping apparatus and said second retaining rod being substantially connected perpendicular to each other and said second retaining rod having a length substantially equal to that of said first retaining rod and parallel thereto, whereby said clamping apparatus reaches and clamps said vessel at an angle complementary to said first mentioned angle, and lifting said vessel by means of said electromagnets and said clamping apparatus with a conventional winding machine for lifting up said tailing rope and said respective guide ropes so that said vessel is supported at four points.

* * * * *